United States Patent [19]

Edison et al.

[11] Patent Number: 5,060,833

[45] Date of Patent: Oct. 29, 1991

[54] CAMEL BACK

[75] Inventors: James M. Edison; Arthur D. Henderson, both of Odessa, Tex.

[73] Assignee: Fastrak Systems, Inc., Odessa, Tex.

[21] Appl. No.: 574,576

[22] Filed: Aug. 24, 1990

Related U.S. Application Data

[63] Continuation of Ser. No. 393,434, Aug. 14, 1989, abandoned.

[51] Int. Cl.[5] ..... A45F 5/00

[52] U.S. Cl. ..... 224/148; 224/209; 224/901; 222/213; 222/175; 251/342; 215/1 A

[58] Field of Search ..... 224/148, 209, 214, 901; 128/207.18, 207.13, 205.22, 202.15; 222/175, 213; 251/342; 215/1 A, 312, 315

[56] References Cited

U.S. PATENT DOCUMENTS

| | | | |
|---|---|---|---|
| 33,343 | 9/1861 | Garrick . | |
| 357,272 | 2/1987 | Donavin . | |
| 1,637,635 | 8/1927 | Corley . | |
| 2,013,358 | 9/1935 | Osborne . | |
| 2,380,372 | 7/1945 | Alderfer . | |
| 2,999,499 | 9/1961 | Willet | 251/342 |
| 3,819,151 | 6/1974 | Kish . | |
| 4,089,447 | 5/1978 | Achmeteli . | |
| 4,090,650 | 5/1978 | Gotta . | |
| 4,139,130 | 2/1979 | Glusker . | |
| 4,176,772 | 12/1979 | Danon . | |
| 4,189,075 | 2/1980 | Hall . | |
| 4,253,454 | 3/1981 | Warncke . | |
| 4,265,381 | 5/1981 | Muscatell . | |
| 4,345,704 | 8/1982 | Boughton | 224/148 |
| 4,449,654 | 5/1984 | Cappis . | |
| 4,469,097 | 9/1984 | Kelman . | |
| 4,544,087 | 10/1985 | Modig . | |
| 4,629,098 | 12/1986 | Eger | 224/148 |
| 4,739,905 | 4/1988 | Nelson . | |
| 4,739,913 | 4/1988 | Moore | 224/214 |

*Primary Examiner*—Linda J. Sholl

*Attorney, Agent, or Firm*—Marcus L. Bates

[57] ABSTRACT

A water system that allows a bicyclist to drink liquids anytime he desires. The system has a collapsible container of water or other liquid stored within a flexible back pack that is removably secured at a location between the shoulders of the bicyclist. A resilient mouthpiece adapted to be held in the mouth of the bicyclist is connected to the container by a length of tubing. The mouthpiece is a valve device and has a cylindrical sidewall that forms a chamber. A spring biased valve element located inside the chamber normally prevents flow therethrough. When the opposed sidewalls of the chamber are compressed between the teeth, liquid flows through the mouthpiece. This allows the mouthpiece to be held securely between the lips and whenever the sidewalls are compressed by the teeth, fluid flows from the container, through the tubing and into the mouth of the bicyclist.

4 Claims, 3 Drawing Sheets

CAMEL BACK

This is a continuation of application Ser. No. 07/393,434 filed Aug. 14, 1989 now abandoned.

BACKGROUND OF THE DISCLOSURE

The water content of our body is extremely important and must be maintained at a suitable level in order to enjoy good health and to avoid the dangers of heat prostration. The rate at which body liquids are aspirated into the atmosphere increases with ambient temperature, humidity, wind velocity, wearing apparel, and power output of the body. Under extreme circumstances, the rate at which moisture is translocated from the body into the atmosphere is alarming and for this reason it is advantageous that liquids be ingested at substantially the same rate at which they are dissipated from the body in order to maintain a feeling of well being and to be able to properly function both mentally and physically.

Athletes, particularly bicyclists and long distance runners, are examples of those who require that water or nutritional liquid be continuously replaced while exercising. This is difficult to achieve because of the complexities involved in simultaneously drinking from a container while pedaling a bicycle, for example. Apparatus by which this can be achieved is the subject of the present invention.

SUMMARY OF THE INVENTION

The present invention comprehends a system that is conveniently supported in attached relationship to a bicyclist's back, for example, and includes a collapsible plastic water bag carried inside a pocket located between the shoulders of the back. A flexible tube extends from the bag to a special valve carried in the bicyclist's mouth. Liquid is metered through the valve upon command by clamping the valve device between the teeth, thereby making available a supply of liquid whenever it is required.

A more specific embodiment of the invention is a back pack made of flexible material that forms an enclosure having an outer wall surface that conforms to one's back and includes fastener means by which it is releasably attached between the shoulders of the bicyclist. The enclosure includes a collapsible plastic water bag carried therewithin and a flexible tubing leads from the lowermost part of the plastic water bag to a valve device.

The valve device is made special for comfortably remaining in one's mouth. The valve device is made of resilient elastomeric material and is of a size to be compressed between the jaws, whereupon the valve device is opened to enable liquid to flow from the plastic water bag into the bicyclist's mouth. The rate of flow can be controlled by the clamping pressure of the jaws.

Additionally, the back pack includes a supply of oxygen having a flow control means thereon connected to a tube leading to the bicyclist's nostrils. The oxygen supply is made available so that it can be used whenever desired.

A primary object of the present invention is the provision of a means by which an athlete has access to a continuous source of liquid.

Another object of this invention is the provision of a means by which an athlete has access to a continuous source of liquid and oxygen.

A still further object of the present invention is the provision of a back pack for a bicyclists which provides a source of liquid and a source of oxygen whenever desired.

An additional object of this invention is the provision of a liquid flow system having a special water container connected to a special valve device which is held in the mouth and actuated as needed.

These and various of other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
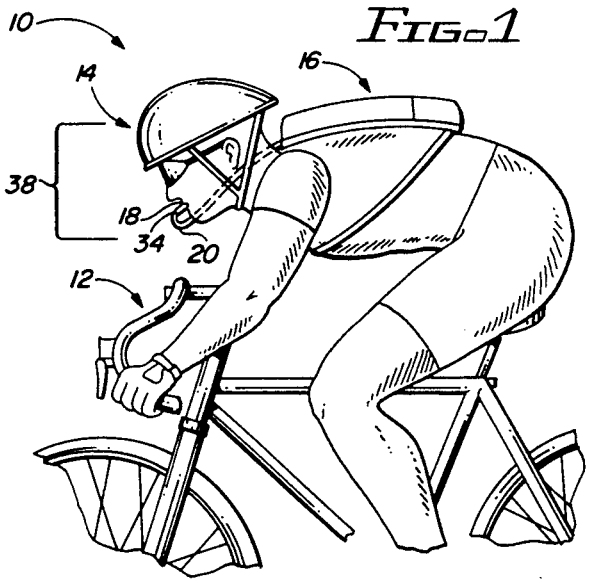
FIG. 1 is a part diagrammatical, part schematical, broken, side elevational view of a bicyclist, with the present invention being diagrammatically illustrated therewith.

In FIG. 1, numeral 10 broadly discloses a bicycle 12 being ridden by a rider or bicyclist 14. The bicyclist has a pack 16, made in accordance with the present invention, attached to his back. Numeral 18 indicates the bicyclist's mouth and a flow conduit 20 leads from the pack 16 to the bicyclist's mouth.

Figure 2:
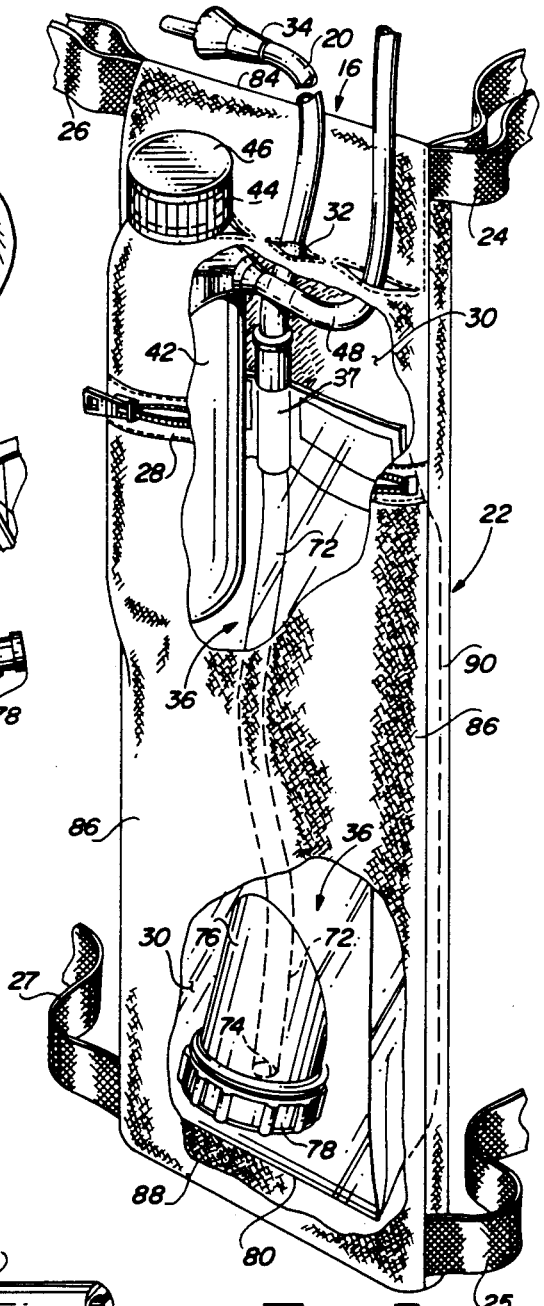
FIG. 2 is a perspective view disclosing the present invention, with some parts thereof being removed therefrom.

FIG. 2 illustrates many of the details of the backpack 16, which includes a main enclosure 22 having a plurality of shoulder straps 24, 25, 26, 27 attached thereto by which the pack can be mounted between the shoulder's of the bicyclist in the manner of FIG. 1. A pocket having an opening that is closed by zipper 28 enables one to gain access to the interior 30 of the enclosure formed within the pack. An outlet 32 is fixed to and extends from the pack, and is connected to the tubing 20, which terminates at a valve device 34, the details of which will be more fully discussed later on.

Figure 3:
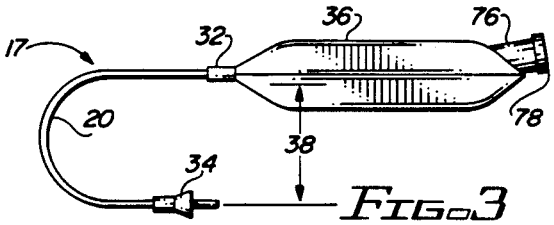
FIG. 3 is a schematical representation of a flow system made in accordance with the present invention.

In FIGS. 2 and 3, it will be noted that the before mentioned outlet 32 is connected to a flexible container 36 having a sealed marginal edge at the upper extremity thereof and a closure member at the lower end thereof so that access to the contents of the container can be gained. Numeral 38 of FIGS. 1 and 3 indicates the hydrostatic head that can be effected between the water level of container 36 and the mouth piece 34.

Figure 4A:
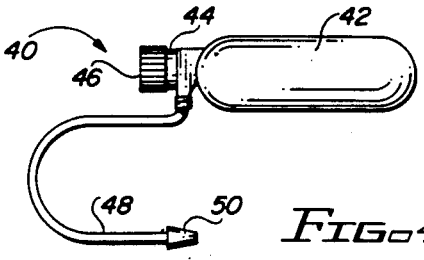
FIGS. 4A and 4B set forth other flow systems made in accordance with the present invention.
Figure 4B:
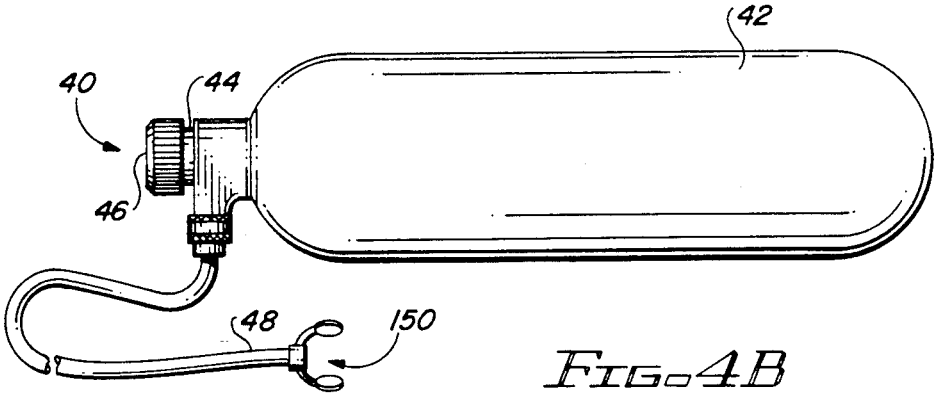

In FIG. 4A, numeral 40 broadly indicates an oxygen system for the bicyclist. The oxygen system includes a tank 42 that is stored within pack 16 (also see FIG. 2). Regulator 44 is connected to the tank and includes adjustable means 46 by which flow of oxygen is controlled through flow line 48 and to an outlet 50. The outlet 50 of FIG. 4A preferably is a tubing held in the bicyclist's mouth, although, as seen in FIG. 4B, it also can be a nasal cannula 150 which can be secured to the bicyclist's nostrils and thereby provide a source of oxygen whenever desired.

Figure 5A:
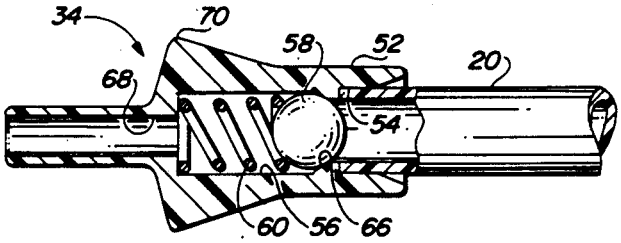
FIGS. 5A and 5B set forth enlarged, part cross-sectional, detailed views of part of the apparatus disclosed in FIGS. 1–3.

FIG. 5A shows the details of the valve device 34 of the previous figures. The valve device 34 is in the form of an elastomeric mouth piece having a reduced diameter shank 52 within which there is an axial passageway which forcibly receives the marginal end of the tubing 20 in sealed relationship therewithin. The passageway 54 enlarges at 66 to form a chamber 56, and is then reduced in diameter at annular wall 62 to form the outlet 68.

Spring 60 is compressed between ball 58 and annular wall 62, thereby biasing the ball 58 against the seat formed near the end of the tube 20. As an alternate feature of the invention, the terminal end of the tube 20 can abut the ball and thereby form a seat respective to the valve element or ball 58. The configuration of the mouth piece 34 enables it to be comfortably held in the mouth for a considerable length of time.

Figure 5B:
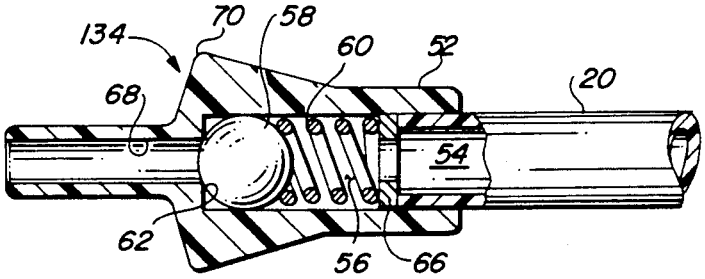
Figure 9B:
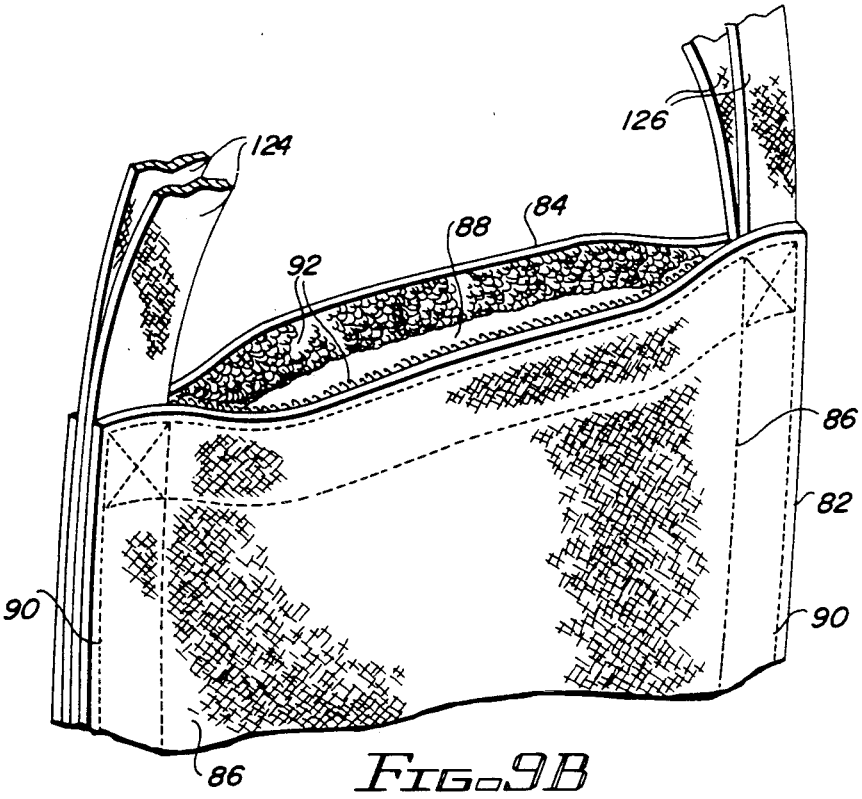

FIG. 5B sets forth an alternate embodiment 134 of the valve device 34 of FIGS. 1 and 5A. The valve device 134 has the ball 58 and spring 60 reversed, with the ball 58 sealingly abutting wall 62 while the opposed ends of the spring 60 are held compressed between the ball 58 and the annular shoulder 66.

Figure 6:
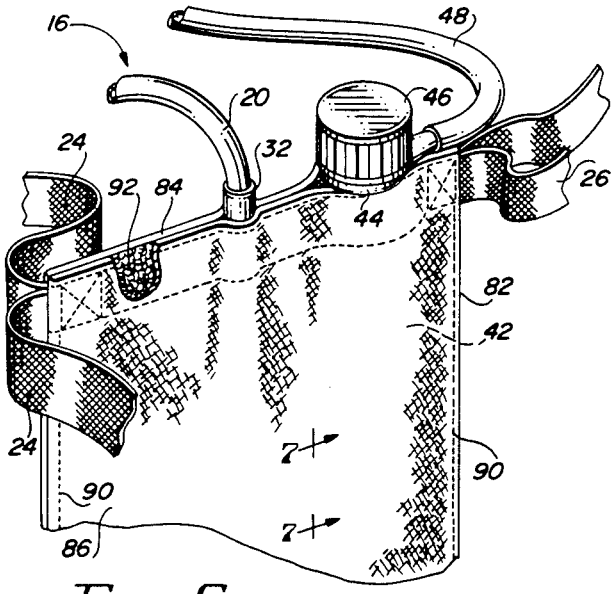
FIG. 6 is a broken, part cross-sectional, detailed view of part of the apparatus disclosed in FIGS. 1–3, with some parts being removed therefrom.
Figure 7:
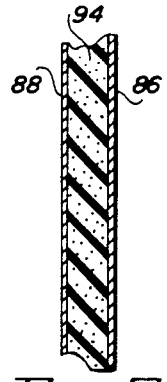
FIG. 7 is a fragmentary, enlarged, detailed, cross-sectional view taken along line 7—7 of FIG. 6.
Figure 9A:
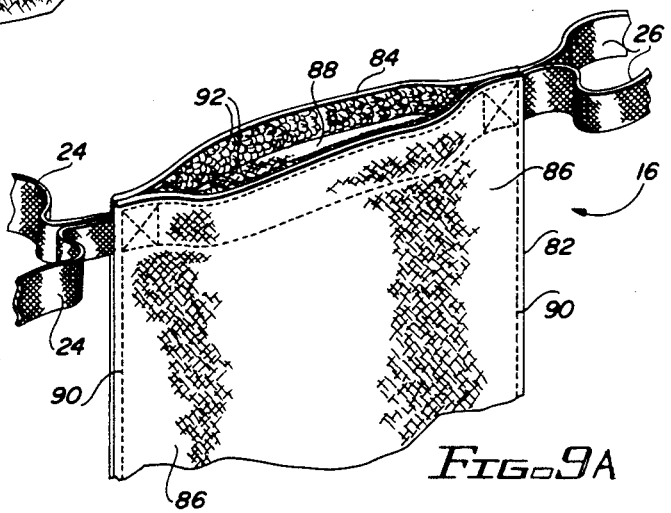
Figure 8:
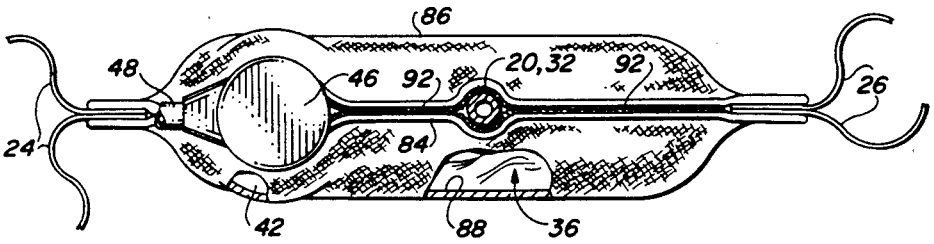
FIG. 8 is a top view of the apparatus of FIG. 6, with some parts being broken away therefrom; and, FIGS. 9A and 9B are broken, perspective, detailed views showing part of the apparatus of FIG. 6.

When the large diameter outer wall part 70 of the mouthpiece is clamped between the teeth, ball valve 58 is upset from the end of tube 20 as seen in FIG. 5A, or seat 62 of FIG. 5B. This allows liquid to flow through tube 20, into chamber 56, and through outlet 68 where it can be ingested by the athlete. Hence, the rate of flow through outlet 68 can be throttled by the clamping pressure of one's jaws. FIGS. 2 and 6 each disclose an arrangement of the water package 36 respective to the pack.

FIGS. 6, 7, 8 and 9A show an alternate embodiment of the invention, and particularly the details of construction of the pack 16 and the manner in which the water system 17 of FIG. 3 and oxygen system 40 of FIG. 4 are assembled therewith.

Accordingly, the present invention provides a unique water, or nutritional liquid delivery system, for athletes, particularly for bicyclists and runners. The novel system comprises a collapsible plastic water bag that is carried inside of a pocket or small backpack located between the shoulders on the athlete's back.

As particularly illustrated in FIG. 2, the system has a flexible plastic tube 72 that extends from the inside bottom of the bag at 74, through the top of the bag at 37, at which location there is provided a quick connector for fast loading of new or replacement water bags. Located at the end of the flexible plastic tube that extends from the quick connector down to the bicyclist's or runner's mouth is the before described special mouthpiece which is of unusual construction and which, when bitten down upon, opens to release the liquid in container 36 to the rider. When the mouthpiece is released, the memory of the resilient material causes it automatically to shut off the flow of liquid to the rider. This is accomplished by utilizing the illustrated ball and spring valve assembly located in the interior 56 of mouthpiece 34.

The mouthpiece action is as follows: the ball is seated into the end of the seat near the end of the tube which has been inserted into the mouthpiece. The spring is located between the ball and the farthest end of the mouthpiece, in FIG. 5A; or, in FIG. 5B the spring is located between the ball and the shoulder 62 of the mouthpiece 134. When the mouthpiece is bitten down upon, the ball is forced back into the inner chamber 56 of the mouthpiece 34 or 134, thus allowing the water to pass into the chamber 56, through the spring 60, and out of the hole at the end of the mouthpiece. When the pressure on the mouthpiece is released, the spring returns the ball into the seated position of FIGS. 5A or 5B.

This system is designed to take advantage of the cooling capabilities of refrigerated liquid by moving it from the frame of a bicycle onto the cyclist's body where it provides a constant cooling action to the back and neck. It is also designed to be safer than current frame mounted systems because of the absence of arm movement that is otherwise necessary to maintain a constant supply of water or premixed liquid refreshment. Moreover, this system does not detract from the aerodynamic quality of the rider nor the bicycle because the placement of the collapsible bag is directly behind the rider's helmet.

In FIG. 2, tube 72 interconnects outlet 32 to the bottom of the collapsible water container 36, with the end 74 of the tubing residing in the filler neck 76 and adjacent to removable closure member 78. The lowermost end of the collapsible water container 36 is seen at 80.

In FIG. 2, the lowermost end 88 of the pack 16 preferably is a medial part of an elongated rectangular piece of flexible material, as for example, woven nylon, with the opposed edges 82 (FIGS. 6 and 9A) being stitched at 90 or otherwise fastened together to provide an outwardly opening enclosure having an opening at the top edge 84 thereof. This provides spaced walls 86, 88 (FIG. 8) fastened together at the periphery thereof. Numeral 90 symbolically indicates stitching of the edges of spaced walls 86, 88. Velcro (TM) fastening material 92 is applied to the inner marginal ends of the inner and outer rectangular pieces of material 86, 88. The straps 24–27 have marginal ends received between the lengths 86, 88 and stitched into the illustrated position.

We claim:

1. A liquid delivery system for a bicyclist, said system includes a back pack that forms an enclosure made of flexible material and having an outer wall surface spaced from an inner wall surface;

the outer and inner wall surfaces have a periphery that is connected to form said enclosure, attachment means for mounting the inner wall to the back of a bicyclist at a location between the shoulders;

a liquid container having flexible sidewalls, said container is located within said enclosure and thereby elevated above the bicyclist's mouth when the bicyclist is in a normal riding position;

a flow line having opposed ends, a valve device in the form of a resilient annular mouthpiece of a size to be held in the bicyclist's mouth, said mouthpiece has an inlet end and an outlet, one end of said flow line is connected to said inlet end of said mouthpiece and the other end of said flow line is connected to said liquid container to receive flow therefrom; a passageway formed through said mouthpiece, a medial length of said passageway enlarges into a chamber having opposed ends, said resilient annular mouthpiece has a medial length that includes a circumferentially extending chamber forming wall within which said chamber is formed, the chamber forming wall is deformed towards said passageway when clamped between the teeth; a valve seat at one end of said chamber through which liquid can flow to said outlet, an annular shoulder at the other end of said chamber through which flow from said one end of said flow line can flow into said inlet end of said mouthpiece and into said chamber;

a valve element in said chamber, a spring means for biasing said valve element, one end of said spring means engages said shoulder at said chamber end that is opposed to the valve seat, and the other end of said spring means engages said valve element and thereby normally biases the valve element into engagement with said valve seat; said valve element is reciprocatingly received within said chamber and is unseated from said valve seat in response to opposed sidewalls of the medial part of said mouthpiece being deformed towards one another;

whereby said mouthpiece is compressed between the teeth, and the opposed sidewalls of the mouthpiece are deformed and forces the valve element and the valve seat away from one another and thereby opens the valve device to permit liquid to flow by gravity from said liquid container, through said flow line, into the inlet of the mouthpiece, through the chamber, through the valve seat, and through the outlet of said mouthpiece where the liquid is made available to the bicyclist.

2. The system of claim 1 and further including a container of compressed oxygen stored in said pack; a regulator, a flow control, a conduit, and means connecting said regulator, conduit, and flow control to enable one to inhale the oxygen that flows from the container.

3. The system of claim 1 wherein said enclosure upwardly opens and includes a closure means by which the opening can be closed, said container has a top and bottom, a filler neck at the bottom thereof and a marginal end of the flow line extends into the top of the container and terminates adjacent to the filler neck.

4. A liquid delivery system for a bicyclist, said system includes a backpack made of flexible material and having an outer wall surface spaced from an inner wall surface; the outer and inner wall surfaces have a periphery that is connected to form an enclosure therewithin; a container for storing liquid therewithin, said container is stored within the enclosure of the backpack; attachment means for mounting the inner wall of the backpack to the back of a bicyclist at a location between the shoulders of the bicyclist that provides a hydrostatic head between said container and the mouth of the bicyclist when the bicyclist is in a normal riding position;

a flow line having opposed ends, a mouthpiece having an inlet and an outlet and is adapted to be held in the mouth and between the teeth, means connecting one end of said flow line to the inlet of the mouthpiece and the other end of the flow line to said container of liquid;

said mouthpiece is in the form of an elongated member having a medial length thereof formed by a circumferentially extending resilient wall that is deformable when held between the teeth an bitten, a passageway formed through said mouthpiece; a valve chamber formed in a marginal length of said passageway at a location that coincides with said medial length of said mouthpiece; a valve device contained within said chamber; an annular valve seat at one end of said chamber opposed to a shoulder at the other end of said chamber, a valve element within said chamber, biasing means between said valve element and said shoulder for biasing said valve element against said annular valve seat to normally preclude flow therethrough; said valve element is forced to move away from said valve seat when opposed sidewalls of said mouthpiece are compressed between the bicyclist's teeth to deform the mouthpiece and thereby deform the resilient wall and force the valve element off the valve seat and thereby allow liquid flow to occur from said container of liquid, through the flow line, and through the mouthpiece where the liquid is made available to the bicyclist.

* * * * *